US006421522B2

(12) United States Patent
Henderson et al.

(10) Patent No.: US 6,421,522 B2
(45) Date of Patent: Jul. 16, 2002

(54) METHOD AND APPARATUS FOR SETTING REGISTRATION IN A MULTICOLOR PRINTING MACHINE BASED ON A CHANGE IN TONER PROFILE

(75) Inventors: Thomas Henderson; Christopher Liston, both of Rochester, NY (US); Patrick Metzler, Gettorf; Karlheinz Walter Peter, Molfsee, both of (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/858,111

(22) Filed: May 15, 2001

Related U.S. Application Data

(60) Provisional application No. 60/204,931, filed on May 17, 2000.

(51) Int. Cl.[7] ..... G03G 15/00

(52) U.S. Cl. ..... 399/301; 399/178

(58) Field of Search ..... 399/301, 178, 399/53, 51, 60, 49

(56) References Cited

U.S. PATENT DOCUMENTS 5,907,344 A * 5/1999 Tanimoto et al. ..... 347/131

FOREIGN PATENT DOCUMENTS

JP 63-113568 * 5/1988
JP 2000047447 * 2/2000

* cited by examiner

*Primary Examiner*—Quana M. Grainger
(74) *Attorney, Agent, or Firm*—Lawrence P. Kessler

(57) ABSTRACT

A method and apparatus for setting registration in a multicolor printing machine having a number of exposure devices for the digital production of color separations, the actions of setting up and combining the color separations being controlled, in order to set the registration, in such a way that accurate registered prints are achieved. According to the invention, in the event of a change in the toner profile, the influence of the toner profile on the registration is taken into account, by available influencing variables directly as the change is implemented.

18 Claims, 1 Drawing Sheet

METHOD AND APPARATUS FOR SETTING REGISTRATION IN A MULTICOLOR PRINTING MACHINE BASED ON A CHANGE IN TONER PROFILE

CROSS REFERENCE TO RELATED APPLICATION

Reference is made to and priority claimed from U.S. Provisional Application Ser. No. 60/204,931, filed on May 17, 2000, entitled: METHOD AND APPARATUS FOR SETTING REGISTER IN A MULTICOLOR PRINTING MACHINE.

FIELD OF THE INVENTION

The invention relates to a method and apparatus for setting registration in a multicolor printing machine for the digital production of color separations, the actions of setting up and combining the color separations being controlled in order to set the registration of the color separations in such a way that accurate registration prints are achieved.

BACKGROUND OF THE INVENTION

Printing colored illustrations, in particular colored images, is carried out by producing a number of color separations and transferring the color separations one over another onto a substrate. These color separations are generally yellow, magenta, and cyan as well as black. If required, special colors are added. By overprinting these color separations, all color combinations can be achieved. The quality of the prints depend significantly on the registration of overprinting of the color separations. In the case of digital printing processes, for example electrostatic printing processes, the maintenance of the registration of the overprint is achieved by the image production devices being controlled in such a way that the color separations meet one another in accurate registration when they are transferred to a printing substrate.

A method and apparatus for multicolor printing are disclosed in U.S. Pat. No. 5,715,498. There, the correction of registration faults is provided by printing and detecting registration marks. The marks are printed with the same toner particles that make up the respective color separations. The drawback with this technical solution is that in the event of a change in the toner profile (i.e., toner thickness on the printing substrate) as a result of a change in the content of the printed page, counteractive control is only possible for the following page, since the effect of the change in an influencing variable (i.e., physical characteristic of toner, substrate, process, etc.) is registered only when it has already caused a fault in registration. As a result, proofs are needed, and time is lost, which is often uneconomic in the case of small jobs and, therefore, not acceptable. Printing individual different printed pages economically is not possible in this way.

SUMMARY OF THE INVENTION

The invention is, therefore, based on the object of developing a method and apparatus for a multicolor printing machine in such a way that a change in the toner profile resulting from a change in the printed page no longer leads to a registration fault, not even temporarily. According to the invention, the object is achieved in relation to the method in that in the event of a change in the toner profile, the influence of the toner profile on the color separation registration is taken into account, by determining available influencing variables, directly as the change occurs. According to the invention, the object is achieved in relation to the apparatus in that the at least one controller is provided that in the event of a change in the toner profile, takes into account the influence of the toner profile on the color separation registration, by determining available influencing variables, directly as the change occurs. As noted, the influencing variables on registration include such things as physical characteristics of the toner, substrate, and process which are directly effected by toner profile changes. For example, toner profile changes may change speeds of rotary members in the printing machine or coefficients of friction between various elements.

The advantage of the invention resides in the fact that, in the event of a change in the toner profile when a printed page is changed, a fault in registration between color separations, which is imminent, is counteracted without any delay. It is no longer necessary to wait until the changed toner profile results in a registration fault that can be detected with the aid of registration marks. Instead, it is possible that directly as the printed page is changed, counteractive control can be carried out and, as a result, the occurrence of a registration fault can be prevented from the outset so that proofs of prints and/or registration marks are generally not necessary. That is to say, any change in toner thickness (profile) can be directly related immediately to its effects on other variables within the print process and the influencing variables can then be taken into account to prevent registration errors. This is of economic significance precisely in the case of small jobs, since machine time, and printing substrates as well can often be saved. With regard to the printing of printed pages with changing content, the result is that it is possible for the first time to achieve a standard of quality which was previously not possible in this important field of use of printing machines with digital image production.

As a result of the measure according to the invention, a registration setting can be optimized with the effect that, in the event of changes in the toner profile, registration does not "get out of hand" initially and require it to be corrected later, but rather that the registration setting remains within the range of tolerable fluctuations, so that during a change in the toner profile, it is possible to continue to print without interruption. At the same time, the invention does not exclude taking into account other influencing variables, if these have an influence on registration.

A development of the method provides that, in the event of a registration correction because of a change in the toner profile, the retroactive influence of the toner profile of the printed pages which have gone before, but are still in the printing process, on the registration of the new printed page already in the printing process is taken into account. In this way, the maintenance of registration in the prints in the event of a change to a printed page with a different image content is even better ensured. The printing machine can continue to print without any interruption even if, between the actions of setting up two color separations, the change in the printed page takes place in such a way that the new color separation is already being set up while the preceding color separation from the previous printed page has not yet or not yet completely been transferred to the printing substrate. The maintenance of registration is, therefore, ensured to a high extent, even in this overlap region between two printed pages, and any mutual influence is compensated for. As a result, the economy of the process is increased significantly, and the printing of printed pages with changing content at high quality is possible. With regard to the apparatus, this is achieved by the at least one controller being such that, in the event of a registration correction caused by a change in the toner profile, the retroactive influence of the toner profile of the printed pages which have gone before, but are still in the printing process, on the registration of the new printed page which is already in the printing process is taken into account by the controller.

A change in a printed page runs through the machine from one printing unit to the next and also, within a printing unit, runs through the printing unit on the path from production as far as transfer to the printing substrate. Accordingly, various machine configurations must be taken into account by variable influencing variables for each printing unit.

The influencing variables of the toner profiles can be taken into account on the basis of stored values based on experience, by manual input, by evaluating digital image data or by automatic detection of the toner profiles. With regard to the apparatus, provision can be made for it to be equipped with at least one memory, which contains stored values based on experience of influencing variables of various toner profiles, the at least one controller controlling the actions of setting up and combining the color separations on the basis of these values based on experience. However, it is also possible to equip the apparatus with an input device, via which the influencing variables of various toner profiles to be taken into account can be activated manually. A further alternative includes providing a printing-machine control system, which contains stored data on printed pages or the data from a number of print jobs, and takes into account the influencing variables of various toner profiles on the basis of this data. A device for the automatic detection of the influencing variables of various toner profiles is also possible.

An expedient configuration with regard to the method provides for the influencing variables of various toner profiles to be determined in accordance with the extent of area coverage of the total image area by the color separations. In this way, it is not necessary to re-measure the influencing variables for each printed page. Instead it is sufficient to determine the extent of area coverage of the total image area for each color separation and, either to calculate the influencing variables from this data for all the printing units, or to determine them from a prepared tabular file. With regard to the apparatus, provision is then made for the device for determining the influencing variables to detect the toner profiles in accordance with the extent of area coverage of the total image area by the color separations. In this case, provision can be made for the device to detect the influencing variables from the digital image data. In order to reduce the outlay on computing, provision can be made for areas with a number of image pixels to be combined during the evaluation of the digital image data.

Essentially, the invention pursues the objective of serving to correct a registration control system. The latter can be such that it is based on the detection of registration marks, which are printed by the individual printing units. In this case, the invention provides that this correction is made before a change in the toner profile can have any influence on the registration marks. The apparatus then has to be configured in such a way that the at least one controller is such that it controls the registration by detecting registration marks which are printed by the individual printing units and detected by a registration mark sensor, and takes into account the influencing variables of the toner profiles as correction factors, the correction being made before a change in the toner profile can have any influence on registration.

However, the invention can also serve to correct a registration control system, which is based on detecting the positions of the elements that carry the color separations and substrate. With regard to the apparatus, provision is then made for the at least one controller to be such that it controls the registration by detecting the positions of the elements that carry the color separations and substrate by position detecting elements, and takes into account the influencing variables of the toner profiles as correction factors. The position detecting elements can be rotary encoders, for example.

Provision can, of course, be made for further influencing variables which have an influence on the registration to be taken into account when setting the registration. These may be, for example, paper grades, paper thicknesses or other influencing variables. With regard to the apparatus, at least one controller must then be provided which takes these further influencing variables into account.

BRIEF DESCRIPTION OF THE DRAWING

The invention will be explained below using an exemplary embodiment illustrated in the FIGURE.

DETAILED DESCRIPTION OF THE INVENTION

Figure 1:
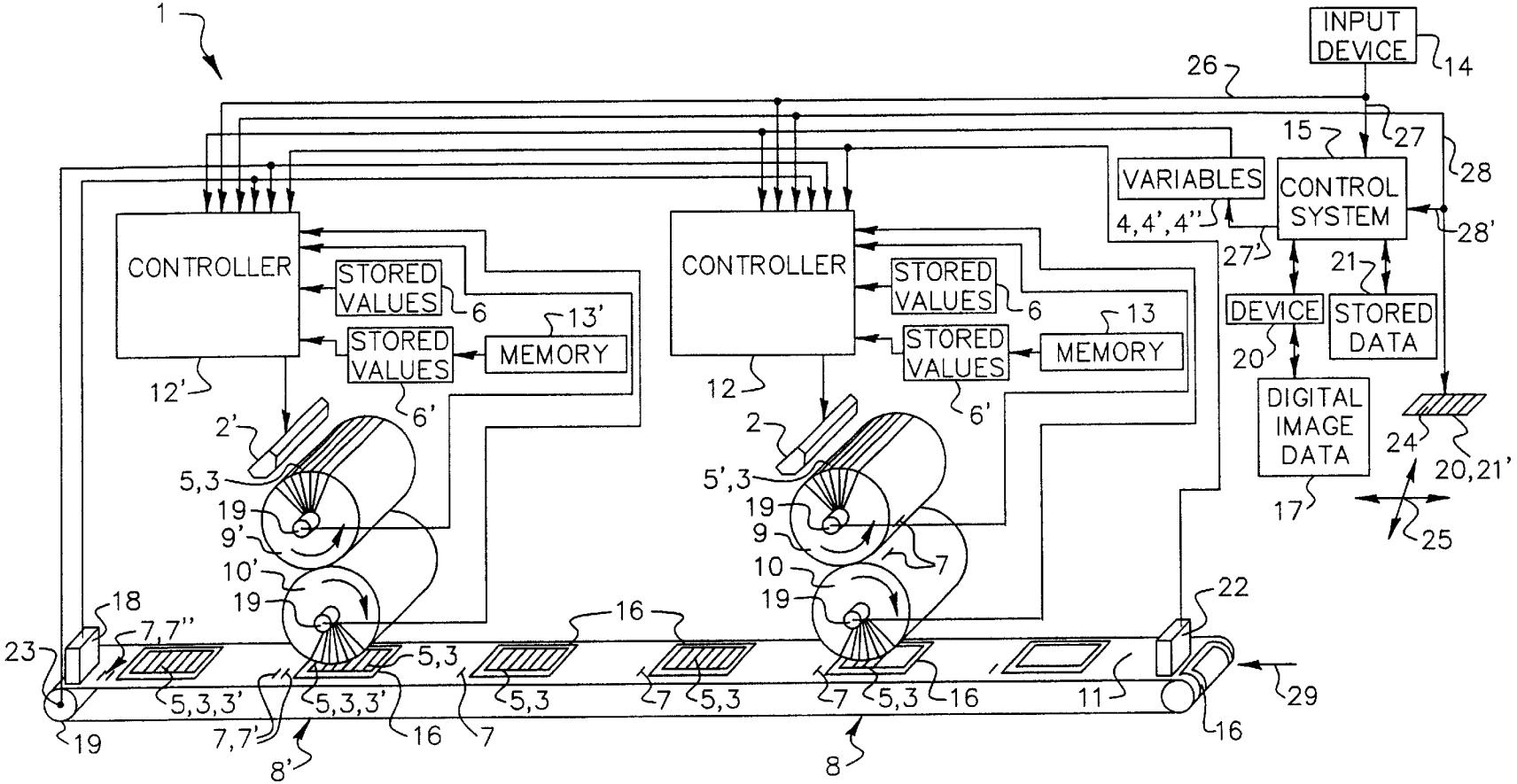

It is of course not necessary for all the alternatives provided in the machine by this invention to be illustrated. For example, it is also possible to provide only one input device 14 with a connection 26 to the controllers 12, 12', . . . , which call up the stored values 6, 6', . . . based on experience for various toner profiles. Alternatively, provision may be made for only the influencing variables 4, 4', . . . to be taken from stored data 21 and/or 17 by the printing-machine control system 15. This can be done automatically or via an input at the input device 14. A further possibility, which is likewise possible separately, is to detect influencing variables by the device 20 described.

However, it is most expedient to provide all the possibilities in the manner illustrated in one machine, in order to be able to select one or the other alternative on the basis of the data available or the critical influencing variables during the operation of the machine. However, the configurations are only exemplary, other methods for obtaining influencing variables and processing the same are conceivable.

PARTS LIST

Multicolor printing machine
2,2', . . . Exposure Device
3,3', . . . Color separations
4,4', . . . Influencing variables of various toner profiles
4 Toner profiles of the preceding printed page
4' Toner profile of the following printed page
5,5'0 Printed pages
5 Preceding printed page
5' Following printed page
6,6', . . . Stored values based on experience for various toner profiles
7,7;, . . . Registration marks
8,8', . . . Printing units
9,9', . . . Image cylinders
10,10', . . . Image transfer cylinders
11 Printing substrate carrier
12,12', . . . Controller to achieve accurate registration prints (for example assigned to the printing units)
13,13 ', . . . Memories
14 Input device
15 Printing machine control system
16 Printing substrates

17 Digital image data
18 Register sensor
19 Position detecting element, for example rotary encoder
20 Device for determining the influencing variables of the toner profiles
20' Denitometer
21 Data from print jobs
22 Sensor for detecting printing substrates
23 Drive roller of the carrier for printing substrates
24 Image
25 Arrow: movement of the image under the device 20, for mple under the densitometer
26 Connection between input device and controllers
27 Connection between input device and printing machine control system
27' Connection between printing-machine control system and controllers (assigned to the printing units)
28 Connection between device 20 and controllers (assigned to printing units)
28' Connection between device 20 and printing machine control system
29 Arrow: transport direction

What is claimed is:

1. A method of setting registration in a multicolor printing machine (1) having a number of exposure devices (2, 2', . . . ) for the digital production of color separations (3, 3', . . . ), the actions of setting up and combining the color separations (3, 3', . . . ) being controlled, for the purpose of setting the registration, in such a way that prints in accurate registration are achieved, wherein: in the event of a change in toner profile, the influence of the toner profile on the registration is taken into account by automatically detecting the toner profiles, by available influencing variables (4, 4', . . . ), taken into account on the basis of stored values (6, 6', . . . ) based on experience, determined in accordance with the extent of area coverage of the total image area by the color separations (3, 3', . . . ), directly as the change is implemented; and in the event of a registration correction resulting from a change in the toner profile, the retroactive influence (4) of the toner profile of the printing pages (5) which have gone before but are still in the printing process on the registration of the new printed pages (5') that are already in the printing process is taken into account.

2. The method as claimed in claim 1, wherein the action of taking the influencing variables (4, 4', . . . ) of the toner profiles into account is activated by a manual input.

3. The method as claimed in claim 1, wherein the influencing variables (4, 4', . . . ) of the toner profiles are taken into account on the basis of the evaluation of digital image data (17).

4. The method as claimed in claim 1, wherein a registration control system, which is based on detecting registration marks (7, 7', . . . ), printed by the individual printing units (8, 8', . . . ), is corrected, this correction being made before a change in the toner profile can have any influence on the registration marks (7, 7', . . . ).

5. The method as claimed in claim 4, wherein a registration control system, based on detecting the positions of the elements (9, 9', . . . ; 10, 10', . . . ; 11) which carry the color separations and substrate is corrected.

6. The method as claimed in claim 5, wherein further influencing variables, which have an influence on the registration, are taken into account when setting the registration.

7. Apparatus for a multicolor printing machine (1) having a number of exposure devices (2, 2', . . . ) for the digital production of color separations (3, 3', . . . ), at least one controller (12, 12', . . . ), in order to achieve accurate registration of prints, performing a registration setting in which the actions of producing and combining the color separations (3, 3', . . . ) are controlled, comprising: at least one controller (12, 12', . . . ) is provided such that in the event of a change in the toner profile, the influence of the toner profile on the registration is taken into account, by available influencing variables (4, 4', . . . ) directly as the change is implemented.

8. The apparatus as claimed in claim 7, wherein the at least one controller (12, 12', . . . ) is such that in the event of a registration correction resulting from a change in the toner profile, the retroactive influence of the toner profile of the printed page (5) which has gone before but is still in the printing process on the registration of the new printed page (5') that is already in the printing process is taken into account.

9. The apparatus as claimed in claim 8, including at least one memory (13, 13', . . . ), which contains stored values (6, 6', . . . ) based on experience of influencing variables (4, 4', . . . ) of various toner profiles, the at least one controller (12, 12', . . . ) controlling the actions of producing and combining the color separations (3, 3', . . . ) on the basis of these values (6, 6', . . . ) based on experience.

10. The apparatus as claimed in claim 9, including an input device (14) via which the influencing variables (4, 4', . . . ) to be taken into account of various toner profiles can be activated manually.

11. The apparatus as claimed in claim 10, wherein a printing machine control system (15) is provided, which contains stored data from print jobs (21), and influencing variables (4, 4', . . . ) of various toner profiles are taken into account on the basis of this stored data (21).

12. The apparatus as claimed in claim 11, including a device (20) for the automatic detection of the influencing variables (4, 4', . . . ) of various toner profiles.

13. The apparatus as claimed in claim 12, wherein the device (20) for determining the influencing variables (4, 4', . . . ) detects the toner profiles in accordance with the extent of area coverage of the total image area by the color separations (3, 3', . . . ).

14. The apparatus as claimed in claim 13, wherein the device (20) detects the influencing variables (4, 4', . . . ) from the digital image data (17).

15. The apparatus as claimed in claim 14, wherein during the evaluation of the digital image data (17), areas with a number of image pixels are combined.

16. The apparatus as claimed in claim 15, wherein the at least one controller (12, 12', . . . ) is such that it controls the registration by detecting registration marks (7, 7', . . . ) which are printed by the individual printing units (8, 8', . . . ) and detected by a registration mark sensor (18), and takes into account the influencing variables (4, 4', . . . ) of the toner profiles as correction factors, the correction being made before a change in the toner profile can have any influence on the registration marks (7, 7', . . . ).

17. The apparatus as claimed in claim 16, wherein the at least one controller (12, 12', . . . ) is such that it controls the registration by detecting the positions of the elements (9, 9', . . . ; 10, 10', . . . ; 11) that carry the color separations and substrate by position detecting elements (19), and takes into account the influencing variables (4, 4', . . . ) of the toner profiles as correction factors.

18. The apparatus as claimed in claim 17, wherein the at least one controller (12, 12', . . . ) is such that, when setting the registration, it takes into account further influencing variables which have an influence on the registration.

* * * * *